US005644989A

United States Patent [19]

Blanchier et al.

[11] Patent Number: 5,644,989

[45] Date of Patent: Jul. 8, 1997

[54] DOUBLE-DECKER RAILCAR WITH CONTINUOUS CIRCULATION ON THE UPPER DECK AND ACCESS FROM A HIGH PLATFORM

[75] Inventors: Patrick Blanchier, Nieul sur Mer; Patrick Harguindeguy, Angoulins sur Mer, both of France

[73] Assignee: GEC Alsthom Transport SA, Paris, France

[21] Appl. No.: 707,074

[22] Filed: Sep. 3, 1996

[30] Foreign Application Priority Data

Sep. 4, 1995 [FR] France ..... 95-10-341

[51] Int. Cl.[6] ..... B61D 3/02

[52] U.S. Cl. ..... 105/340; 105/8.1

[58] Field of Search ..... 105/8.1, 340, 343

[56] References Cited

U.S. PATENT DOCUMENTS

| | | | |
|---|---|---|---|
| 1,724,149 | 8/1929 | Self | 105/340 |
| 2,143,827 | 1/1939 | Demarest | 105/340 |
| 2,811,932 | 11/1957 | Clary | 105/340 |
| 2,946,295 | 7/1960 | Dean | 105/340 |
| 5,063,859 | 11/1991 | Radar | 105/340 |

FOREIGN PATENT DOCUMENTS

| | | | |
|---|---|---|---|
| 0616934A1 | 9/1994 | European Pat. Off. . | |
| 0621164A1 | 10/1994 | European Pat. Off. . | |
| 0625457A1 | 11/1994 | European Pat. Off. . | |
| 10960 | 1/1991 | Japan | 105/340 |

*Primary Examiner*—S. Joseph Morano

*Attorney, Agent, or Firm*—Sughrue, Mion, Zinn, Macpeak & Seas

[57] ABSTRACT

A double-decker railcar with continuous circulation on the upper deck and access from a high platform has at least one access door to the railcar the bottom of which is at the level of the high platform. An intermediate access landing to the railcar is level with the bottom of the access door inside the railcar. An access stairway to the upper deck runs from the intermediate landing and an access stairway to the lower deck also runs from the intermediate landing. A stairwell contains at least parts of the access stairway to the lower deck, the intermediate landing and the access stairway to the upper deck. A floor of the upper deck is truncated in a given area delimiting the stairwell at the level of the upper deck. The floor of the upper deck defines a continuous plane to enable continuous circulation on the upper deck.

7 Claims, 6 Drawing Sheets

DOUBLE-DECKER RAILCAR WITH CONTINUOUS CIRCULATION ON THE UPPER DECK AND ACCESS FROM A HIGH PLATFORM

BACKGROUND OF THE INVENTION

1. Field of the Invention

The present invention concerns the diagrams of railcars in general and in particular a double-decker railcar with continuous circulation on the upper deck and access from a high platform.

2. Description of the Prior Art

In existing double-decker railcars, to move from one vehicle to the next, either from the upper deck or from the lower deck, it is necessary to ascend or to descend a stairway of several steps.

The diagrams proposed for prior art double-decker railcars make circulation on the train particularly difficult for passengers and totally impossible for catering trolleys.

This drawback of the diagrams of prior art double-decker railcars is due to the difficulty of laying out the equipment, units, stairways and passenger space.

Moreover, the diagrams of prior art double-decker railcars are applicable only to railcars accessible from medium-height platforms and are therefore not applicable to railcars accessible from a high platform.

By medium-height platforms is meant platforms with a height of not less than 550 mm and by high platforms is meant platforms with a height of 1,000 mm or greater.

One object of the invention is to provide a double-decker railcar with continuous circulation on the upper deck and access from a high platform featuring a judicious layout of the equipment, units, stairways and passenger space.

Another object of the invention is to provide a double-decker railcar with continuous circulation on the upper deck and access from a high platform in which circulation from one railcar to the next is effected on the upper deck without ascending or descending steps.

SUMMARY OF THE INVENTION

In accordance with the invention, a double-decker railcar with continuous circulation on the upper deck and access from a high platform, includes:

at least one access door to said railcar the bottom of which is at the level of said high platform, an intermediate access landing to said railcar inside said railcar level with said bottom of said access door, an access stairway to the upper deck running from said intermediate landing, an access stairway to the lower deck running from said intermediate landing, a stairwell containing at least parts of said access stairway to said lower deck, said intermediate landing and said access stairway to said upper deck, and a floor of said upper deck truncated in a given area delimiting said stairwell at the level of said upper deck, said floor of said upper deck defining a continuous plane to enable continuous circulation on said upper deck.

The double-decker railcar of the invention with continuous circulation on the upper deck and access from a high platform also has at least one of the following features:

it includes two access doors, one of said access doors being disposed on one face of said railcar and the other access door being disposed on the other face of said railcar, said access doors being offset relative to each other, said access doors are disposed above a bogie at the ends of said railcar, said intermediate landing has a depth less than the width of said railcar at the level of said intermediate landing, a volume under the floor of said upper deck and running along said stairwell is able to accommodate equipment, part of a volume above the floor of the upper deck and running along the stairwell is able to accommodate equipment and/or ancillary passenger space and/or part of the upper saloon, and a volume above the upper part of said access door and above said stairwell accommodates equipment and/or ancillary passenger space.

One advantage of the double-decker railcar of the invention with continuous circulation on the upper deck and access from a high platform is that it has a high capacity.

Another advantage of the double-decker railcar of the invention with continuous circulation on the upper deck and access from a high platform is that it enables circulation along a train on the upper deck.

Other objects, features and advantages of the invention will emerge from a reading of the description given below with reference to the appended drawings of a preferred embodiment of the double-decker railcar with continuous circulation on the upper deck and access from a high platform.

DETAILED DESCRIPTION OF THE PREFERRED EMBODIMENT

Figure 1:
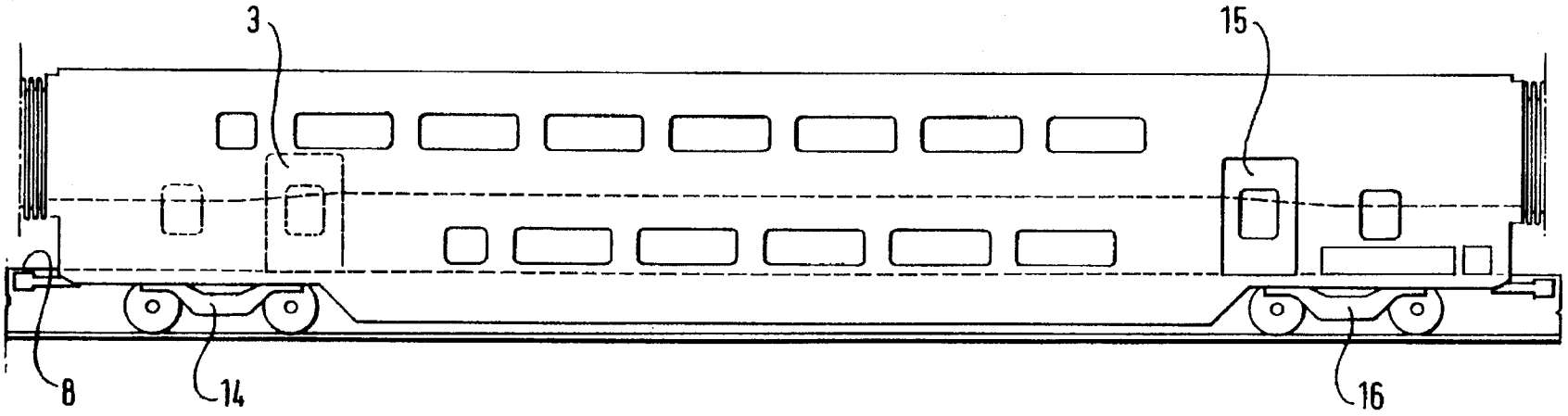
FIG. 1 is a general view of a double-decker railcar of the invention with continuous circulation on the upper deck and access from a high platform.

FIG. 1 is a general view of the double-decker railcar of the invention with continuous circulation on the upper deck and access from a high platform.

The double-decker railcar of the invention with continuous circulation on the upper deck and access from a high platform 8 has a first access door 3 to the railcar above a first bogie 14 at one end of the railcar and a second access door 15 to the railcar above a second bogie 16 at one end of the railcar.

There are preferably at least two access doors.

One of the access doors is on one of the lateral faces of the railcar and the other access door is on the other lateral face of the railcar.

The access doors are offset relative to each other and therefore do not face each other.

An advantage of a layout of this kind, or of a diagram of this kind, is a new distribution of the volumes intended to receive equipment, units, stairways and passenger space.

Another advantage of a diagram of this kind is to provide new combinations for the layout of equipment, units, stairways and passenger space, in combinations that have not previously been possible.

Another advantage of a diagram of this kind is to provide access to the railcar from either of its lateral faces.

Figure 2:
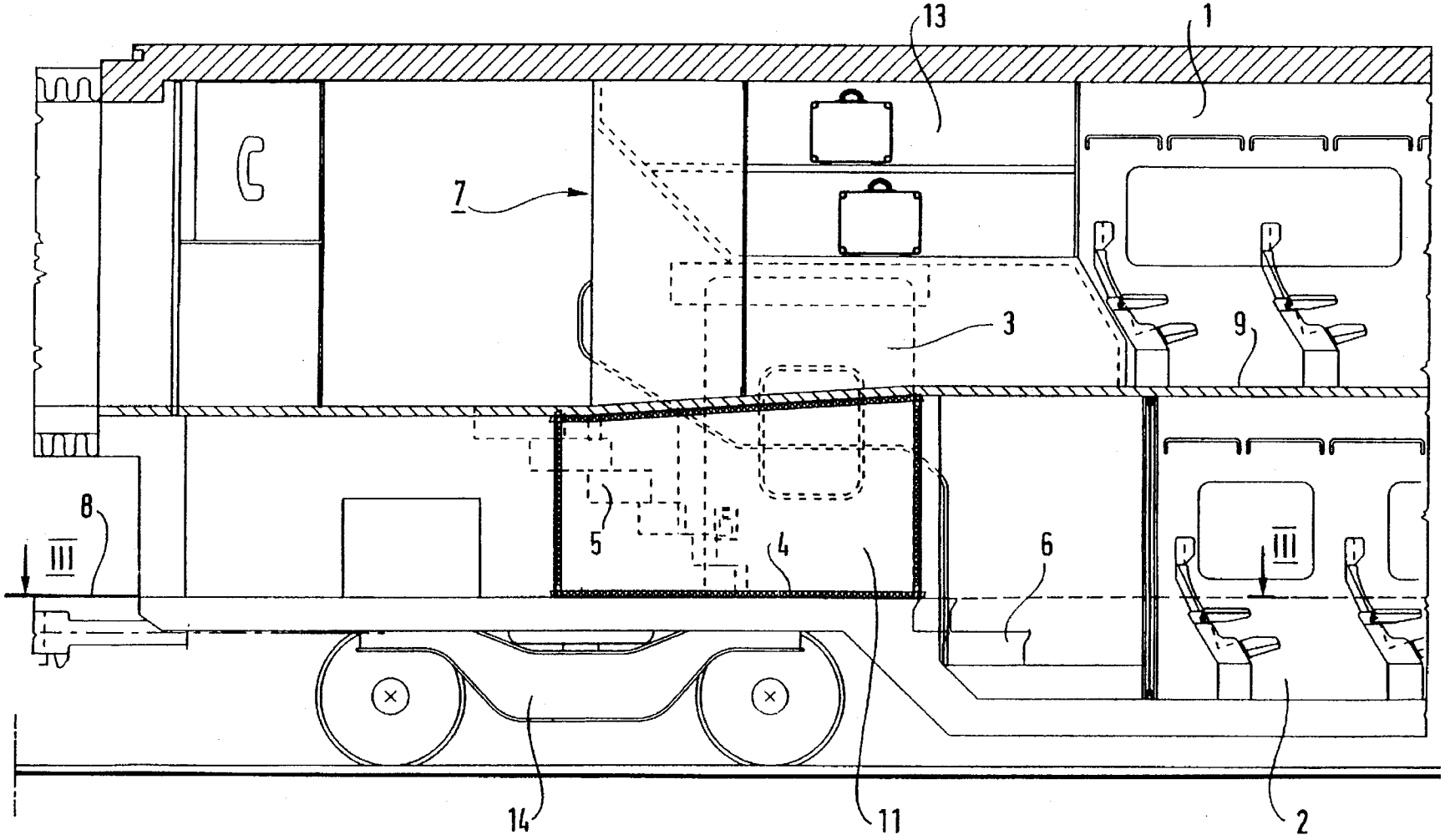
FIG. 2 is a view in lateral section of the first end of the double-decker railcar of the invention with continuous circulation on the upper deck and access from a high platform.

FIG. 2 is a view in lateral section of the first end of the double-decker railcar of the invention with continuous circulation on the upper deck 1 and access from a high platform 8.

An access door 3 to the railcar is disposed on the lateral face of the railcar.

The bottom of the access door is level with the high platform 8.

An intermediate access landing 4 to the railcar level with the bottom of the access door is disposed inside the railcar.

An access stairway 5 to the upper deck 1 and an access stairway 6 to the lower deck 2 run from the intermediate landing 4.

The access stairway 6 to the lower deck, the intermediate landing 4 and the access stairway 5 to the upper deck constitute, at least partially, a stairwell 7.

Figure 3A:
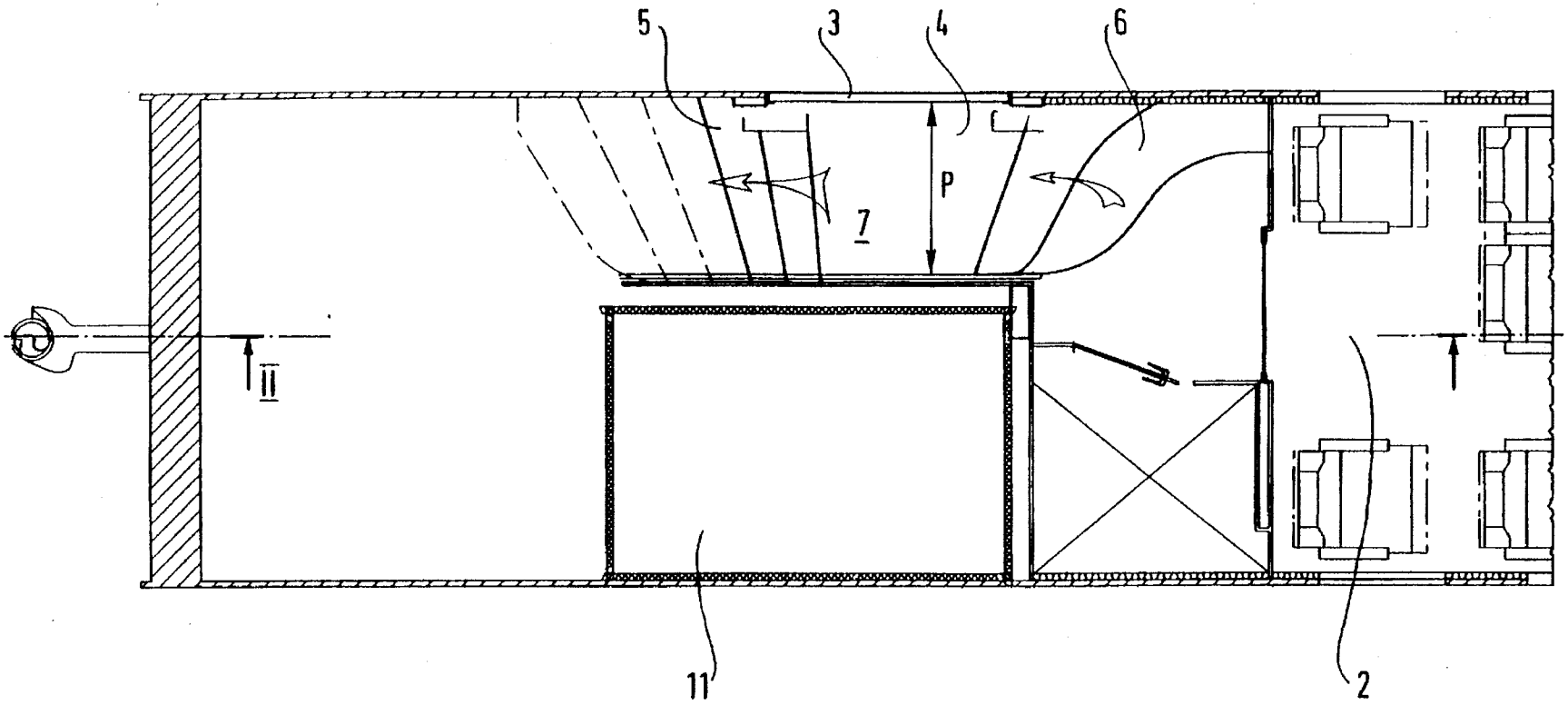
FIGS. 3A and 3B are respectively longitudinal views in section on a horizontal plane of the first end and the second end of the lower deck of the double-decker railcar of the invention with continuous circulation on the upper deck and access from a high platform.
Figure 3B:
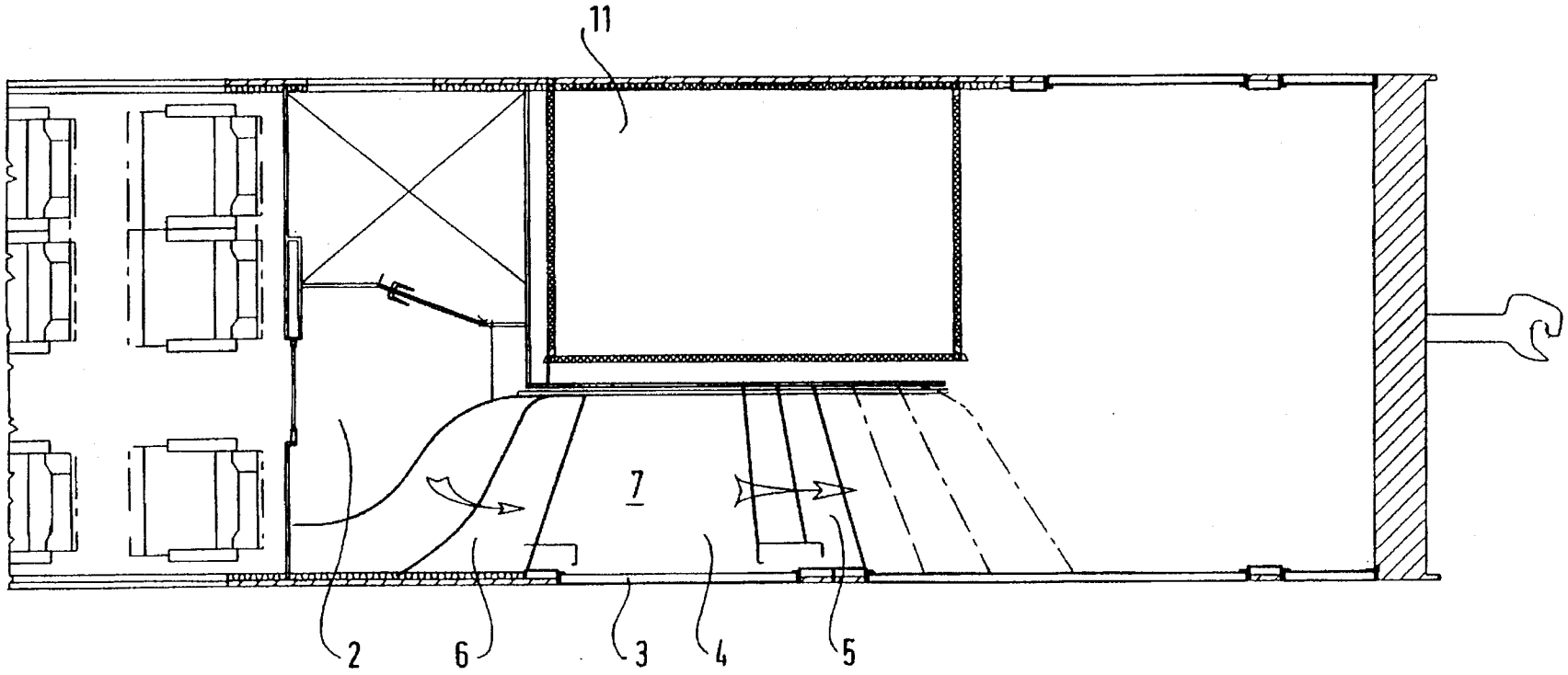

FIGS. 3A and 3B are respectively longitudinal views in section on a horizontal plane of the first end and the second end of the lower deck 2 of the double-decker railcar of the invention with continuous circulation on the upper deck and access from a high platform.

FIGS. 3A and 3B show the access door 3 to the railcar, the access intermediate landing 4 to the railcar, the access stairway 5 to the upper deck, the access stairway 6 to the lower deck 2 and the stairwell 7.

The access intermediate landing 4 to the railcar level with the bottom of the access door is disposed inside the railcar.

In the embodiment shown in FIGS. 3A and 3B the railcar is such that the intermediate landing 4 has a depth P less than the width of the railcar at the location of the intermediate landing 4.

The volume 11 under the floor 9 of the upper deck 1 running along the stairwell 7 is able to accommodate equipment, for example an air conditioning unit.

Figure 4A:
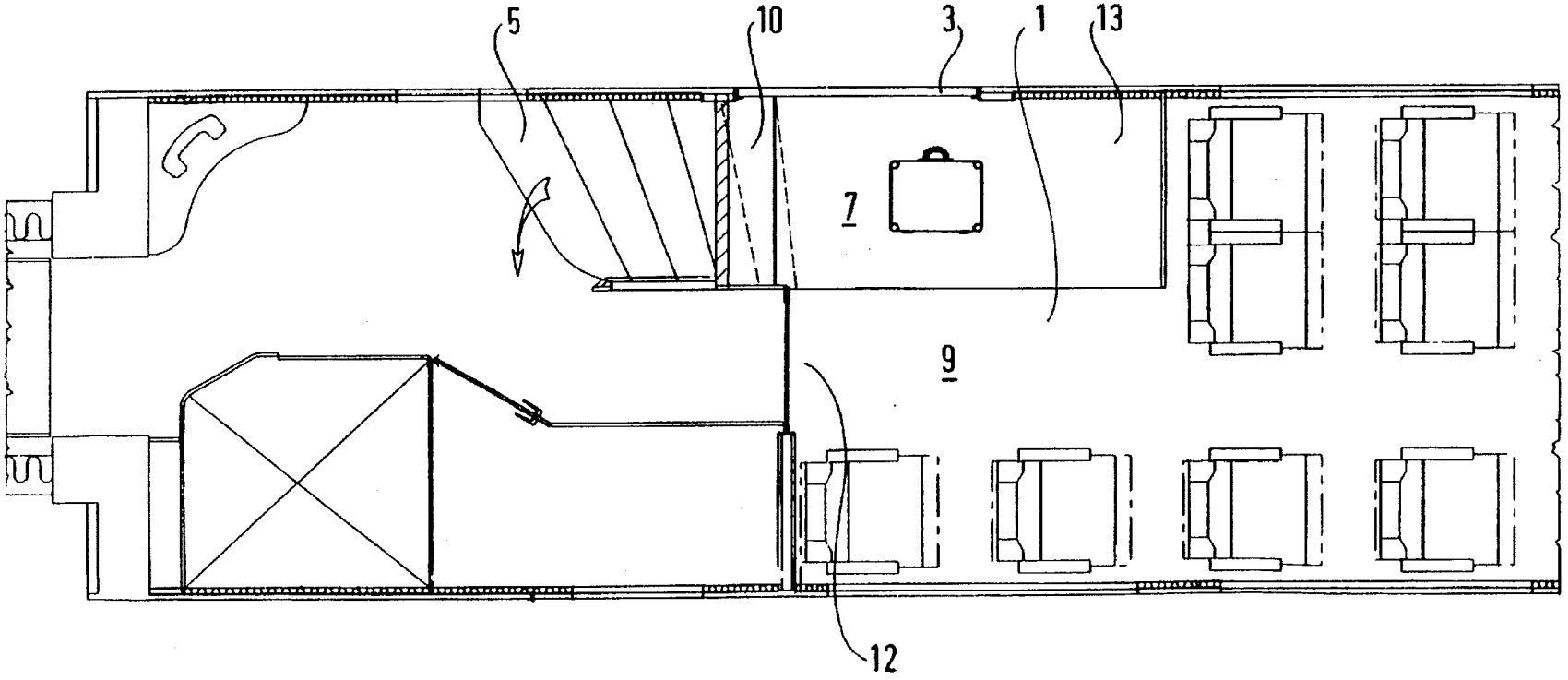
FIGS. 4A and 4B are respectively longitudinal views in section on a horizontal plane of the first end and the second end of the upper deck of the double-decker railcar of the invention with continuous circulation on the upper deck and access from a high platform.
Figure 4B:
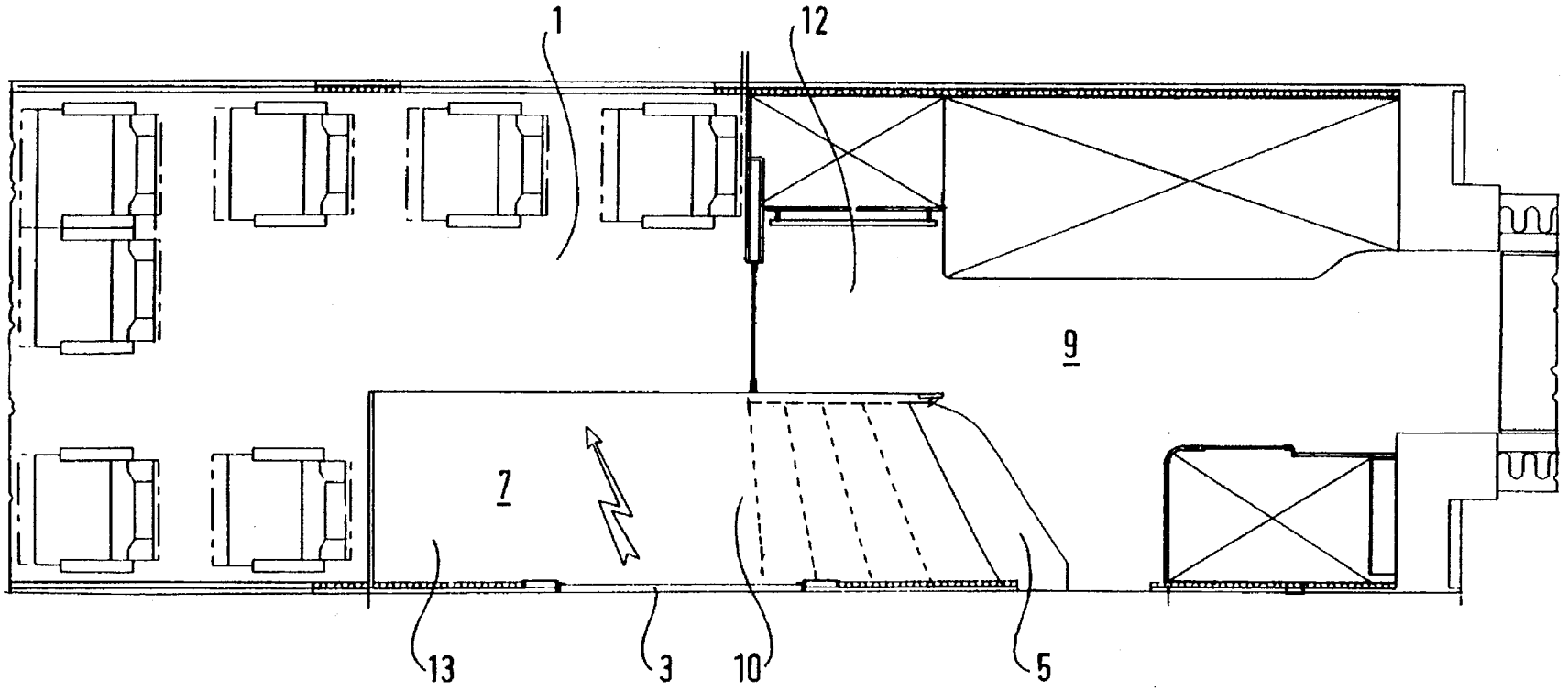

FIGS. 4A and 4B are respectively longitudinal views in section on a horizontal plane of the first end and the second end of the upper deck 1 of the double-decker railcar of the invention with continuous circulation on the upper deck and access from a high platform.

The upper deck 1 has a floor 9 the width of which corresponds to the width of the railcar at the level of the floor of the upper deck 1.

FIGS. 4A and 4B also show the upper part of the access door 3 to the railcar, the access stairway 5 to the upper deck and the stairwell 7.

The floor 9 of the upper deck 1 is truncated in a given area 10 delimiting the stairwell 7 at the level of the upper deck, the floor 9 of the upper deck 1 defining a continuous plane to enable continuous circulation on the upper deck.

The volume 12 above the floor 9 of the upper deck 1 and running along the stairwell 7 is designed to enable continuous circulation of passengers on the upper deck.

A part of this volume 12 can accommodate equipment and/or ancillary passenger space and/or a part of the upper saloon.

The volume 13 above the upper part of the access door 3 and above the stairwell 7 can accommodate equipment and/or ancillary passenger space, for example a luggage rack.

There is claimed:

1. A double-decker railcar with continuous circulation on the upper deck and access from a high platform, including:

at least one access door to said railcar the bottom of which is at the level of said high platform, an intermediate access landing to said railcar inside said railcar, level with said bottom of said access door, an access stairway to the upper deck running from said intermediate landing, an access stairway to the lower deck running from said intermediate landing, a stairwell containing at least parts of said access stairway to said lower deck, said intermediate landing and said access stairway to said upper deck, and a floor of said upper deck truncated in a given area delimiting said stairwell at the level of said upper deck, said floor of said upper deck defining a continuous plane to enable continuous circulation on said upper deck.

2. A railcar as claimed in claim 1 including two said access doors, one of said access doors being disposed on one face of said railcar and the other access door being disposed on the other face of said railcar, said access doors being offset relative to each other.

3. The railcar claimed in claim 1 wherein said at least one access door is disposed above a bogie at the end of said railcar.

4. The railcar claimed in claim 1 wherein said intermediate landing has a depth less than the width of said railcar at the level of said intermediate landing.

5. The railcar claimed in claim 1 wherein a volume under the floor of said upper deck and running along said stairwell is able to accommodate equipment.

6. The railcar claimed in claim 1 wherein part of a volume above the floor of said upper deck and running along said stairwell is able to accommodate equipment and/or ancillary passenger space and/or part of an upper saloon.

7. The railcar claimed in claim 1 wherein a volume above the upper part of said access door and above said stairwell accommodates equipment and/or ancillary passenger space.

* * * * *